US008299893B2

(12) United States Patent
Mullet

(10) Patent No.: US 8,299,893 B2
(45) Date of Patent: Oct. 30, 2012

(54) OPERATOR SYSTEM UTILIZING A POSITION DETECTOR TO INITIATE A CLOSING SEQUENCE

(75) Inventor: Willis J. Mullet, Gulf Breeze, FL (US)

(73) Assignee: Homerun Holdings Corporation, Pensacola, FL (US)

( * ) Notice: Subject to any disclaimer, the term of this patent is extended or adjusted under 35 U.S.C. 154(b) by 931 days.

(21) Appl. No.: 12/077,274

(22) Filed: Mar. 18, 2008

(65) Prior Publication Data

US 2009/0237202 A1 Sep. 24, 2009

(51) Int. Cl.
*G08C 19/00* (2006.01)

(52) U.S. Cl. ..... 340/5.71

(58) Field of Classification Search ..... 340/545.1, 340/547, 825.69, 12.22, 5.71, 5.7; 318/466, 318/280; 455/38.3, 231; 701/301, 202; 180/365; 307/10.1

See application file for complete search history.

(56) References Cited

U.S. PATENT DOCUMENTS 5,969,637 A * 10/1999 Doppelt et al. ..... 340/12.55
6,002,332 A * 12/1999 King ..... 340/545.1
6,109,384 A * 8/2000 Bromley et al. ..... 180/242
6,229,988 B1 * 5/2001 Stapefeld et al. ..... 340/7.35
6,271,765 B1 * 8/2001 King et al. ..... 340/12.22
6,615,132 B1 * 9/2003 Nagasaka et al. ..... 701/200
7,088,265 B2 8/2006 Tsui et al. ..... 340/988
7,327,107 B2 2/2008 Mullet et al. ..... 318/280
7,363,130 B2 * 4/2008 Sakakibara ..... 701/36
7,818,127 B1 * 10/2010 Duggan et al. ..... 701/301
2002/0087262 A1 * 7/2002 Bullock et al. ..... 701/202
2002/0140289 A1 * 10/2002 McConnell et al. ..... 307/10.1
2007/0046231 A1 * 3/2007 Mullet et al. ..... 318/280
2008/0088410 A1 4/2008 Mullet et al. ..... 340/5.7
2008/0164973 A1 7/2008 Mamaloukas ..... 340/5.7

* cited by examiner

*Primary Examiner* — Jennifer Mehmood
*Assistant Examiner* — Kaleria Knox
(74) *Attorney, Agent, or Firm* — Renner Kenner Greive Bobak Taylor & Weber

(57) ABSTRACT

Mobile transmitter configured to control any compatible barrier operator so as to move an access barrier to a closed position based on the change in angular and/or linear position of a carrying device. The mobile transmitter includes a position sensor and an activity sensor to monitor the change in position of the carrying device. Thus, when the angular and/or linear position of the carrying device changes by an amount greater than a predetermined threshold, the mobile transmitter automatically communicates a mobile command signal to the barrier operator commanding it to close the access barrier.

8 Claims, 6 Drawing Sheets

OPERATOR SYSTEM UTILIZING A POSITION DETECTOR TO INITIATE A CLOSING SEQUENCE

TECHNICAL FIELD

Generally, the present invention relates to a barrier control system to control an access barrier and methods for programming and using the same. More particularly, the present invention relates to the use of a mobile transmitter maintained by a carrying device, such as a vehicle, to initiate the closing of an access barrier depending upon the amount of angular change that is experienced by the carrying device during its movement. Specifically, the present invention relates to a mobile transmitter maintained by a carrying device having an angle position detector and an activity sensor configured to selectively close an access barrier when the carrying device experiences a predetermined amount of angular change and/or moves a predetermined linear distance.

BACKGROUND

When constructing a home or a facility, it is well known to provide access barriers, such as garage doors, which utilize a motorized barrier operator to provide opening and closing movements of the door. Aside from garage doors, the barrier operator may also be coupled with other types of movable access barriers such as gates, windows, retractable overhangs, protective curtains and the like. In order to open and close the access barrier, a barrier operator is configured to receive command input signals from a wired or wireless transmitter. It is also known to provide safety devices that are connected to the barrier operator for the purpose of detecting an obstruction so that the barrier operator may then take corrective action with the motor to avoid entrapment of the obstruction by the access barrier.

As previously mentioned, wireless transmitters are configured to allow users to conveniently actuate the access barrier in a desired direction without getting out of their car. Additionally, such remote devices may also be provided with additional features such as the ability to control multiple doors, lights associated with the doors, and other security features. As is well documented in the art, the remote devices and operators may be provided with encrypted codes that change after every operation cycle so as to make it virtually impossible to "steal" a code and use it at a later time for illegal purposes. An operation cycle may include opening and closing of the access barrier, as well as turning on and off a light that is connected to the barrier operator and so on.

Although remote transmitters and like devices work well, they can be cumbersome and distracting to the driver, as his or her hands are occupied with maintaining a controlled grip over the steering wheel, or gear shift while exiting the garage or driveway. Depending on the radio frequency range of the transmitter, they can close a barrier, such as a garage door, outside the user's line of sight such that if the safety devices on the operator malfunction the user can close the door on a person standing in the doorway. As such, the potential damage resulting from the inadvertent actuation of the remote transmitter while the vehicle is in the path of the access barrier is increased. Furthermore, the switch mechanism and the battery connections of the remote device typically become worn after a period of time and requires replacement. To overcome this disadvantage, various systems for the "hands-free" operation of the remote transmitter have been developed. Such hands-free systems comprise a mobile transmitter that communicates, via various mobile signals, with a base operator that is configured to actuate an access barrier, such as a garage door, between open and closed positions. The mobile transmitter is generally carried by a carrying device, such as a vehicle, and is configured to transmit mobile signals to the base operator so as to move the access barrier between open and closed positions, depending on the relative position of the carrying device to the base operator, as well as other criteria.

Many of the hands-free systems of the prior art utilize a mobile transmitter that is carried by a suitable carrying device, such as a vehicle, which communicates with the barrier operator, through signals periodically sent to the mobile transmitter, such that when no return signal is received, the barrier operator commands the access barrier to close. Unfortunately, such a manner of operation allows the closing of the access barrier to be potentially initiated with the user out of visual range of the barrier, which may result in safety concerns, as the user may be led to believe that the barrier has closed, or become obstructed with a person (child) when in fact an obstruction has caused the door to open and remain open allowing unauthorized access to others.

Alternatively, other hands-free systems may utilize a system of communication, wherein a mobile transmitter repeatedly transmits at least one identification signal for receipt by the barrier operator. Prior art based upon the received identification signal and other input, the barrier operator controls movement of the door or access barrier. One particular type of hands free implementation used to control the barrier operator utilizes a timeout delay function, whereby when the barrier operator has failed to receive a predetermined number of identification signals, the controller sends a close command the access barrier is automatically closed. However, such systems have a tendency to be inaccurate due to the fact that they rely on the detection of a plurality of signals sent by the mobile transmitter in order to ascertain whether the mobile transmitter has moved away from the barrier operator by a sufficient distance to warrant the automatic closure of the access barrier places the user to far away from the line of sight of the barrier. In particular, inaccuracies may arise due to various sources of interference that may corrupt a transmitted signal, including that of electrical noise for example. To overcome such deficiency associated with transmitting and detecting a plurality of signals to detect the position of a mobile transmitter, various attempts have been made to utilize positional indicators to identify the specific position of the carrying device as it moves relative to the barrier operator. Unfortunately, such systems require that the microprocessor or controller that processes the data generated by such devices be configured to perform floating point and/or vector operations upon the data received from such detection systems, which generally translates into a significant amount of processing overhead for the microprocessor or controller being utilized. As such, to achieve such a level of computational performance, a high-performance microprocessor or controller is required, which is generally a source of undesired expense when contemplating the development and manufacture of such a mobile transmitter.

Therefore, there is a need in the art for an operator system that automatically initiates only the closing sequence for an access barrier depending upon the change in angular position of a carrying device without the need of floating point or vector based mathematical operations. In addition, there is a need for an operator system that utilizes a mobile transmitter that includes an angle position detector that is configured to monitor the change in the angular position of a carrying device as it is removed from an enclosure whose access is controlled by the access barrier and closes predictably within the line of sight of the user. Furthermore, there is a need for an operator system that provides a mobile transmitter that includes an activity sensor, such as an accelerometer, so as to automatically close an access barrier when a carrying device has reached a predetermined linear distance from the access barrier. Still yet, there is a need for a hands-free operator system that provides a mobile transmitter that is configured with an accelerometer that is capable of discriminating between unintended movement, such as the accidental movement of the mobile transmitter within a carrying device, and movement resulting from the acceleration of the carrying device, so as to accurately control the movement of the access barrier within the line of sight of the user.

SUMMARY OF THE INVENTION

In light of the foregoing, it is a first aspect of the present invention to provide an operator system utilizing a position detector to initiate a closing sequence.

Another aspect of the present invention is to provide a system to command any barrier operator to automatically close an open access barrier based on a change in position of a carrying device comprising a mobile transmitter adapted to transmit a command signal receivable by the barrier operator, the mobile transmitter configured to be maintained by the carrying device, and a position detector in operable communication with the mobile transmitter to monitor the change in position of the carrying device, wherein the mobile transmitter transmits the command signal to the barrier operator so as to close the open access barrier when the position detector detects that the position of the carrying device has changed by a predetermined amount.

Yet another aspect of the present invention provides a transmitter to command any compatible barrier operator to automatically close an open access barrier based on a change in position of a carrying device comprising a position detector to monitor the change in position of the carrying device, an activity sensor coupled to the carrying device to detect when the carrying device is active, an emitter adapted to transmit a mobile signal receivable by the barrier operator, and a mobile controller coupled to each of the position detector, the activity sensor, and the emitter, wherein the mobile transmitter is activated when the activity sensor detects that the carrying device is active, and wherein when the mobile transmitter is active, the emitter transmits the mobile signal to the barrier operator to close the open access barrier when the position detector detects that the angular position of the carrying device has changed by a predetermined amount.

Still another aspect of the present invention provides a method of automatically closing an open access barrier based on a change in position of a carrying device comprising providing a mobile transmitter configured to detect the change in position of a carrying device, the mobile transmitter configured to transmit mobile signals, providing any barrier operator compatible with the mobile transmitter to control the movement of the access barrier between limit positions, moving the carrying device from a first position to a second position, determining whether the angular change of the carrying device exceeds a predetermined threshold angle value, and transmitting a mobile signal to the barrier operator to automatically close the open access barrier, within the line of sight of the user, if the angular change in position of the carrying device exceeds the predetermined threshold angle value.

Yet another aspect of the present invention is to provide a system to command any barrier operator to automatically close an open access barrier based on a change in position of a carrying device comprising a mobile transmitter adapted to transmit a signal receivable by the barrier operator, the mobile transmitter configured to be maintained by the carrying device, an activity sensor coupled to the carrying device to detect when the carrying device is active, a position detector in communication with the mobile transmitter to monitor the change in position of the carrying device, wherein the mobile transmitter is activated when the activity sensor detects that the carrying device is active, such that when the mobile transmitter is active, the transmitter transmits the command signal to the barrier operator so as to close the open access barrier when the position detector detects that the position of the carrying device has changed by a predetermined amount.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
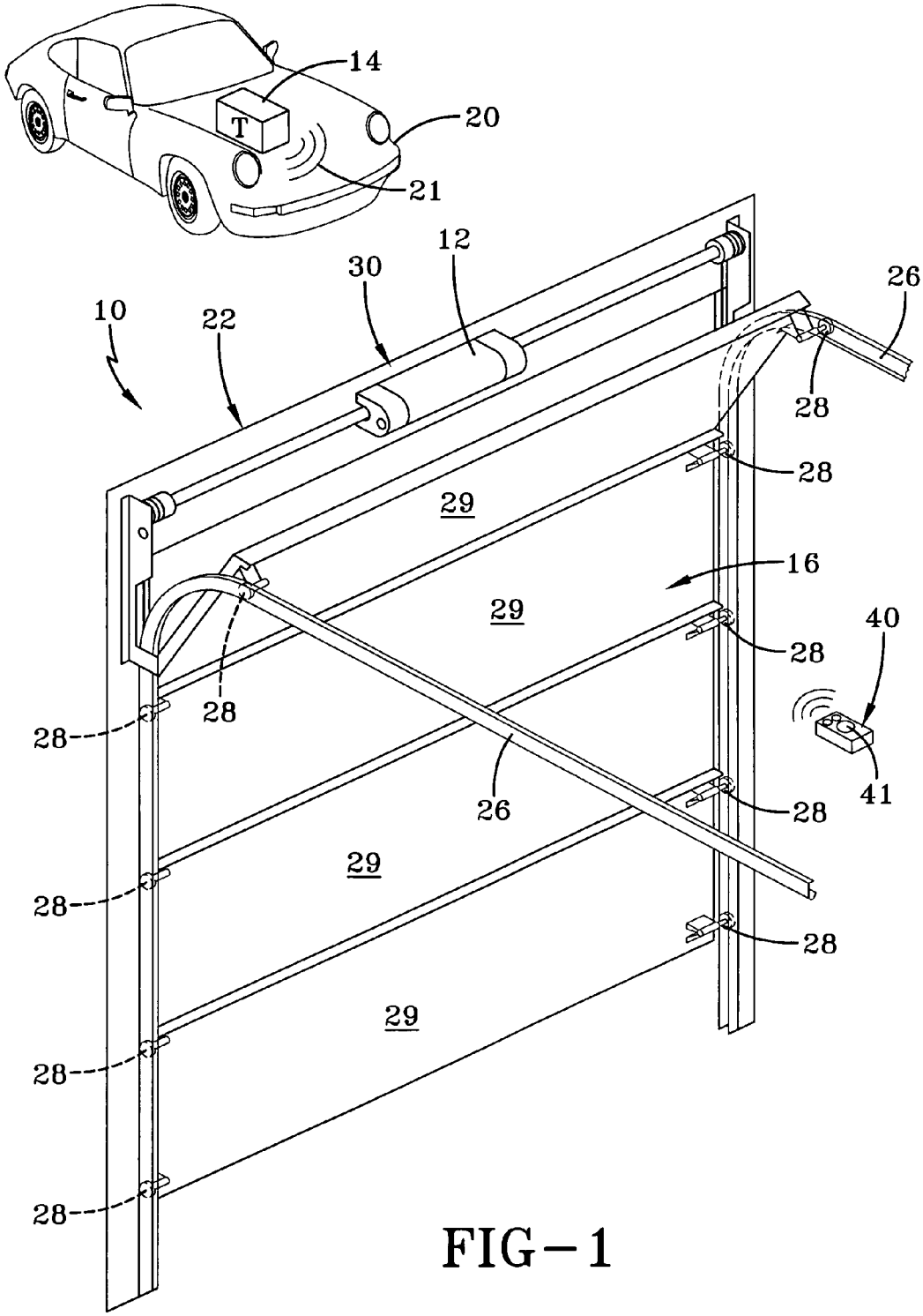
FIG. 1 is a schematic perspective view of a system for enabling operation of a mobile transmitter and any barrier operator in accordance with the concepts of the present invention.

A system, such as a hands-free operator system, which incorporates the concepts of the present invention, is generally designated by the numeral 10 in FIG. 1. Although the present discussion is specifically related to an access barrier such as a garage door, it will be appreciated that the teachings of the present invention are applicable to other types of barriers, such as single panel doors, gates, windows, curtains, retractable overhangs and any device that at least partially encloses or restricts access to an area. Moreover, the teachings of the present invention are applicable to locks or an automated control of any device based upon an operational status, position, or change in the angular or linear position of a mobile transmitter to be discussed. Indeed, it is envisioned that the present teachings could be used to ensure closure and/or locking of automobiles, houses, buildings and the like.

The barrier operator system 10 is configured to provide control over the various functions and features provided by a barrier operator 12. In particular, the system 10 utilizes a mobile transmitter 14 that is configured to communicate mobile commands, such as a mobile close command, in a format compatible for receipt by the barrier operator 12, so as to selectively control the closing movement of the access barrier 16 that controls access to an area in a hands-free manner. In other words, the mobile transmitter 14 is adapted to be operable with any barrier operator 12 so as to enable the hands-free closing of the access barrier 16. As such, the mobile transmitter 14 may be provided as a standalone device that may subsequently be associated with any barrier operator 12, so as to initiate the automatic closure of the access barrier 16.

The present embodiment is directed to a system that initiates the hands-free closing of the barrier. It will be appreciated that such an embodiment can be used with an operator system that is part of an overall hands-free system that is used to control both the opening and the closing of the barrier. Or the present embodiment could be used in conjunction with a user-actuated system, where the mobile transmitter automatically initiates a closing sequence as described, and a user actuates a selected button on the mobile transmitter itself or another learned transmitter itself to initiate an opening sequence of the barrier.

The mobile transmitter 14 is carried by a carrying device 20, such as a vehicle, and includes various systems, such as an angle position detector, an activity sensor and/or an accelerometer to monitor the angular and linear movements of the carrying device 20 as it is moved from the area whose access is controlled by the access barrier 16. As such, when the angular or linear movements of the carrying device 20 exceed a predetermined threshold value maintained by the mobile transmitter 14, the mobile transmitter 14 automatically transmits a signal 21, which may also be referred to as a mobile signal or a mobile command signal, to the barrier operator 12 to move the access barrier 16 to a closed position from an open position in an appropriate manner. To ensure that the carrying device 20 is not within the path of movement of the access barrier 16 as it is being closed, the predetermined angular threshold and/or linear threshold values are selected to correspond to positional changes that would be attained only when the carrying device 20 has sufficiently cleared the threshold defined by the access barrier's path of movement. The system 10 may also be configured so that the components of the mobile transmitter 14 may be integrated into the electronics of a particular carrying device 20, such as a vehicle.

Alternatively, it is also contemplated that the mobile transmitter 14 may be sold or provided separately from the carrying device 20 as a standalone device, allowing it to be later added or retrofitted therewith. As such, the mobile transmitter 14 is configured so that it can communicate with any barrier operator, including but not limited to the barrier operator 12, thus allowing the mobile transmitter 14 to provide hands-free closure to any access barrier attached thereto. It should also be appreciated that the mobile command, which may also be referred to herein as a close command, is transmitted using a signal having a format that is compatible for receipt by any barrier operator, including the barrier operator 12. For example, the mobile signal transmitted by the mobile transmitter 14 may comprise a frequency of about 300 to 400 Mhz, although any suitable frequency may be used. In view of the compatibility of the mobile transmitter 14 with legacy operators—those already installed or manufactured prior to introduction of the transmitter 14—it will be appreciated that the signal generated upon detection of an angle and/or distance change is functionally equivalent to a normal button actuation of a remote transmitter used to open or close an access barrier. With the general concepts of the system 10 set forth, the following detailed discussion of the system 10 is presented, for the purposes of clarity, in three subject matter areas: the barrier operator; the hands-free mobile transmitter; and operation of the mobile transmitter with the barrier operator.

I. Operator

The operator system 10 is configured to be employed in conjunction with the conventional sectional garage door or other movable access barrier 16, as shown in FIG. 1. The opening in which the access barrier 12 is positioned for opening and closing movements relative thereto is surrounded by a frame 22. A track 26 extends from each side of the door frame and receives a roller 28 which extends from the top edge of each door section 29.

Affixed to the frame 22 is the barrier operator 12 that is operatively coupled to the access barrier 16 by an actuation system 30. Although a header-mounted operator is disclosed, the control features to be discussed are equally applicable to other types of operators used with movable barriers. The control features disclosed are also applicable to any type of actuation system, which changes states or condition (open/off/close/off).

Briefly, the barrier operator 12 may be controlled by a wireless remote transmitter 40. The remote transmitter 40 requires manual actuation of a button 41 to initiate movement of the access barrier 16 between opened and closed positions.

Figure 2:
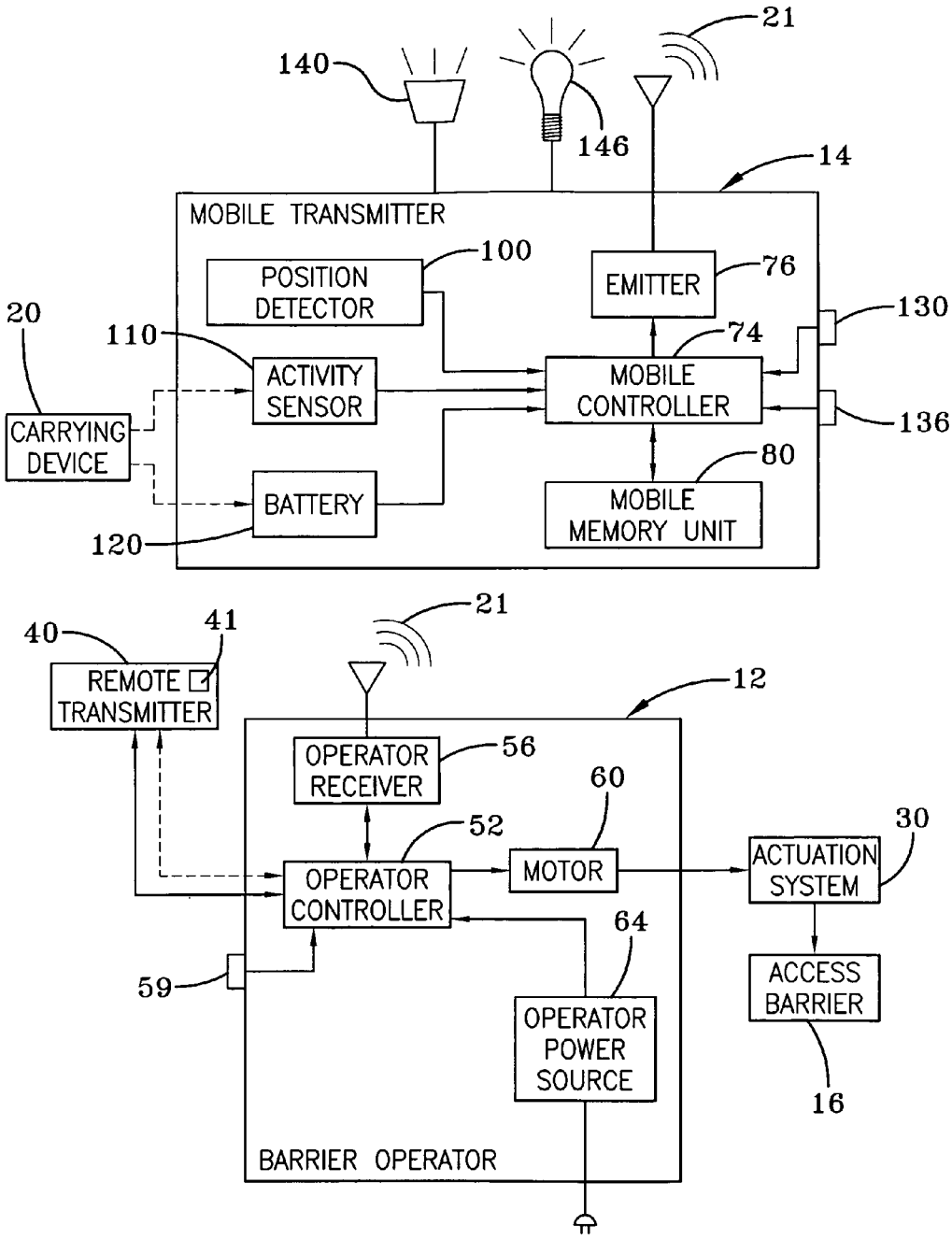
FIG. 2 is a block diagram of any barrier operator system and an associated mobile transmitter in accordance with the concepts of the present invention.

Specifically, the barrier operator 12 includes an operator controller 52, as shown in FIG. 2, which incorporates the necessary software, hardware and memory for controlling the operation of the overall system 10.

The operator receiver 56 may be configured to receive signals from the transmitter 40 in a frequency range of approximately 300 to 400 Mhz for example, although other frequencies may be used. The operator receiver 56 may also receive mobile command signals, such as a close command signal, that is in a frequency range of 900 to 950 MHZ as well. Of course, other frequency ranges compatible with the system 10 and approved for use by the appropriate government agency may be used, as the mobile transmitter 14 is configured to be operative with any barrier operator.

Thus, if a command signal is received from the remote transmitter 40 found to be acceptable, the operator controller 52 generates the appropriate electrical input signals for energizing a motor 60, which enables the actuation system 30 so as to open/stop and/or close/stop the access barrier 16. A learn button 59 may also be associated with the operator controller 52, wherein actuation of the learn button 59 allows the operator controller 52 to learn any of the different types of transmitters 40 used in the system 10, including the mobile transmitter 14.

In addition, to enable the operation of the barrier operator 12, an operator power source 64 is provided. The power source 64 is configured to convert mains power, such as that provided by a standard residential outlet, into a format that is compatible with the components of the barrier operator 12.

II. Mobile Transmitter

The mobile transmitter 14 is provided by the system 10, and effectively operates in much the same manner as the wireless transmitter 40, except direct manual input from the user is not required to close the access barrier 16, although manual input could be provided via one or more control buttons provided thereby. As will be discussed in detail, the mobile transmitter 14 is typically placed within the carrying device 20, such as in the glove compartment, or attached to the sun visor of a vehicle for example, and initiates the automatic closing of the access barrier 16 when a change in the position of the carrying device 20, which may include a change in angular and/or linear position, exceeds a predetermined threshold value. As a result, the mobile transmitter 14 initiates a convenient hands-free closing sequence of the access barrier 16.

In particular, the mobile transmitter 14 includes a mobile controller 74 that is configured with the necessary hardware, software, and memory to enable the functions to be discussed. Coupled to the mobile controller 74 is an emitter 76 that comprises a transmitter that is capable of generating and transmitting a command signal 21, such as a close command signal, that is compatible for receipt by the barrier operator 12. The mobile transmitter 14 also includes a mobile memory unit 80 that is coupled to the mobile controller 74. The mobile memory unit 80 may comprise volatile memory, non-volatile memory, or a combination of both. In one aspect, the mobile memory unit 80 may store various predetermined values, including an angle threshold value and/or a distance threshold value. The memory may also store factory preset values for angle change and distance values. In addition, the mobile memory unit 80 together with the mobile controller 74 facilitate generation of the appropriate data to include in the mobile command signal 21 inasmuch as one mobile transmitter 14 may be associated with multiple barrier operators 12 or in the event multiple mobile transmitters 14 are associated with a single barrier operator 12. In other words, the barrier controller 52 is able to distinguish the mobile signals 21 of different mobile transmitters 14 and act upon them accordingly. The system 10 will most likely be configured so that any command generated by the mobile transmitter 14 to move the access barrier 16 in the form of command signals 21 can be cancelled or overridden by any command transmitted from the transmitter 40. Furthermore, the mobile memory unit 80 may maintain system mobile state variables, count values, timer values, signal counts and the like which are utilized to enable operation, as will be discussed.

To monitor the movement of the carrying device 20, the mobile transmitter 14 includes a position detector 100, and an activity sensor 110, each of which are coupled to the mobile controller 74. The position detector 100 may comprise a digital compass, an analog compass, a two-axis compass, a tilt switch, a gyroscope, or a GPS (global positioning system) receiver, an accelerometer as well as any other device suitable for detecting positional or angular change of the carrying device 20, and any combination of the foregoing devices and generating a corresponding angle position signal. If an accelerometer is included in the position detector 100, it can be a multi-axis. accelerometer, that is configured to detect changes in acceleration in the X, Y, and Z directions. The position detector 100 is primarily used to detect a change in angular orientation, but in some embodiments the detector may also detect a change in linear position. The position detector 100 serves as a position detector allowing the mobile transmitter 14 to determine when the carrying device 20 has changed its positional orientation with respect to a predetermined angle threshold value and/or a linear distance threshold value stored at the mobile memory unit 80. As such, when the angular position of the carrying device 20 or linear distance that the carrying device 20 is away from the access barrier 16 exceeds that identified by the predetermined threshold values, the mobile transmitter 14 automatically commands the barrier operator 12 which will close an open access barrier 16. In other words, the mobile transmitter 14 may simply be placed in a glove compartment or console, as well as clipped to a sun visor of an automobile or other carrying device 20, and communicates with the operator controller 52 of the barrier operator 12 for the purpose of automatically closing the access barrier 16 depending upon the change in angular position and/or change in linear movement of the carrying device 20 while the barrier is still in the user's line of sight.

The activity sensor 110 is configured to detect whether the carrying device is active—in an on condition or moving—and may comprise an accelerometer, such as a multi-function accelerometer that can detect changes in acceleration in the X, Y, Z directions. It should also be appreciated that the position detector 100 and the activity sensor 110 may be configured to discriminate between the position changing movements of the carrying device 20 as a result of driving, and the incidental movements of the mobile transmitter 14 resulting from the jostling movements or vibrations imparted to the mobile transmitter 14 through normal use. Such ability to discriminate between these movements allows the mobile transmitter 14 to precisely identify the positional changes of the carrying device 20. An accelerometer is believed to be ideally suited to determine linear displacement, although the previously mentioned devices described above could be used.

The mobile transmitter 14 also includes a replaceable or rechargeable battery 120 that is configured to provide power to the various components comprising the mobile transmitter 14. It is also contemplated that in another embodiment the mobile transmitter 14 may be connected to an accessory switch or ignition switch, or associated power switching circuit maintained by the carrying device 20, such that power from the carrying device's battery is selectively provided to the mobile transmitter 14. Thus, such a configuration allows the mobile transmitter 14 to be powered directly by the carrying device 20 in lieu of a separate battery 120. Generation of an operational signal by the carrying device 20 may be detected by the mobile transmitter 14 via the activity sensor 110, the accessory/ignition switch or associated power switching circuit so as to allow the mobile transmitter 14 to be activated only when the carrying device 20 is operational. Thus, once energized via the actuation of the carrying device's accessory/ignition switch or associated switching circuitry, through the mobile controller 74, the mobile transmitter 14 is operable to detect changes in the angular and/or linear position of the carrying device 20.

It is also contemplated that the mobile transmitter 14 may also include a learn/door move button 130 and an on/off button 136 that provides various functions to be discussed below. In one aspect, the learn/door move button 130 when actuated in accordance with a predetermined sequence enables the mobile transmitter 14 to be learned to the barrier operator 12 when the barrier operator 12 is placed in a learn mode after the learn button 59 of the selected operator has been actuated. As such, after the mobile transmitter 14 is learned to the barrier operator 12, the user is no longer required to press a door move button or otherwise locate the mobile transmitter 14, or use the remote transmitter 40 before having the access barrier 16 close as the carrying device 20 leaves the area, in accordance with the concepts presented herein, whose access is controlled by the access barrier 16. If needed, actuation of the learn/door move button 130 in accordance with another predetermined sequence, allows the mobile transmitter 14 to override normal operation of the mobile transmitter 14, so as to directly control the opening and closing of the access barrier 16. That is, the learn/door move button 130 may be manually actuated so as to directly open or close the access barrier 12 as desired as known in the art. Alternatively, when the on/off button 136 is placed in to the "off" state, the hands-free features provided by the mobile transmitter 14 are disabled, such that the automatic closure of the access barrier 16 in accordance with the concepts presented herein are prevented until the on/off button 136 is placed into the "on" state. It is also contemplated that the actuation of the learn/door move button 130 and the on/off button 136 allows the mobile controller 74 to be programmed with updated angle threshold and/or linear distance threshold values for storage at the mobile memory unit 80. For example, the angle threshold value may be programmed to comprise a value of at least 15 to 45 degrees for example, although any suitable angle may be used, whereas the linear distance threshold value may be programmed to comprise a value between about 15 to 500 feet, although any suitable distance may be used. Re-programming of the threshold values may be done wirelessly, or the controller 74 and/or the memory unit may be provided with a port that allows for direct re-programming.

It is also contemplated that the mobile transmitter 14 may include an audio source 140 and a light source 146 such as a light-emitting diode. It is envisioned that the audio source 140 and/or the light source 146 may be employed to provide audio or verbal instructions/confirmation or light indications as to certain events that need the immediate attention of the person utilizing the mobile transmitter 14. The audio and light sources 140 and 146 may also provide confirmation or rejection of the attempted programming or learning functions invoked by the buttons 130 and 136.

While the previous discussion of the mobile transmitter 14 relates to a system that enables the automatic closure of the access barrier 16, it is also contemplated that the mobile transmitter 14 may be programmed or otherwise configured to provide for the hands-free control of other systems maintained by the barrier operator 12. For example, the mobile transmitter 14 may be configured to turn the light 62 on and off, as well as to control various other functions, when a predetermined change in angle or distance has been attained by the carrying device 20.

Figure 3:
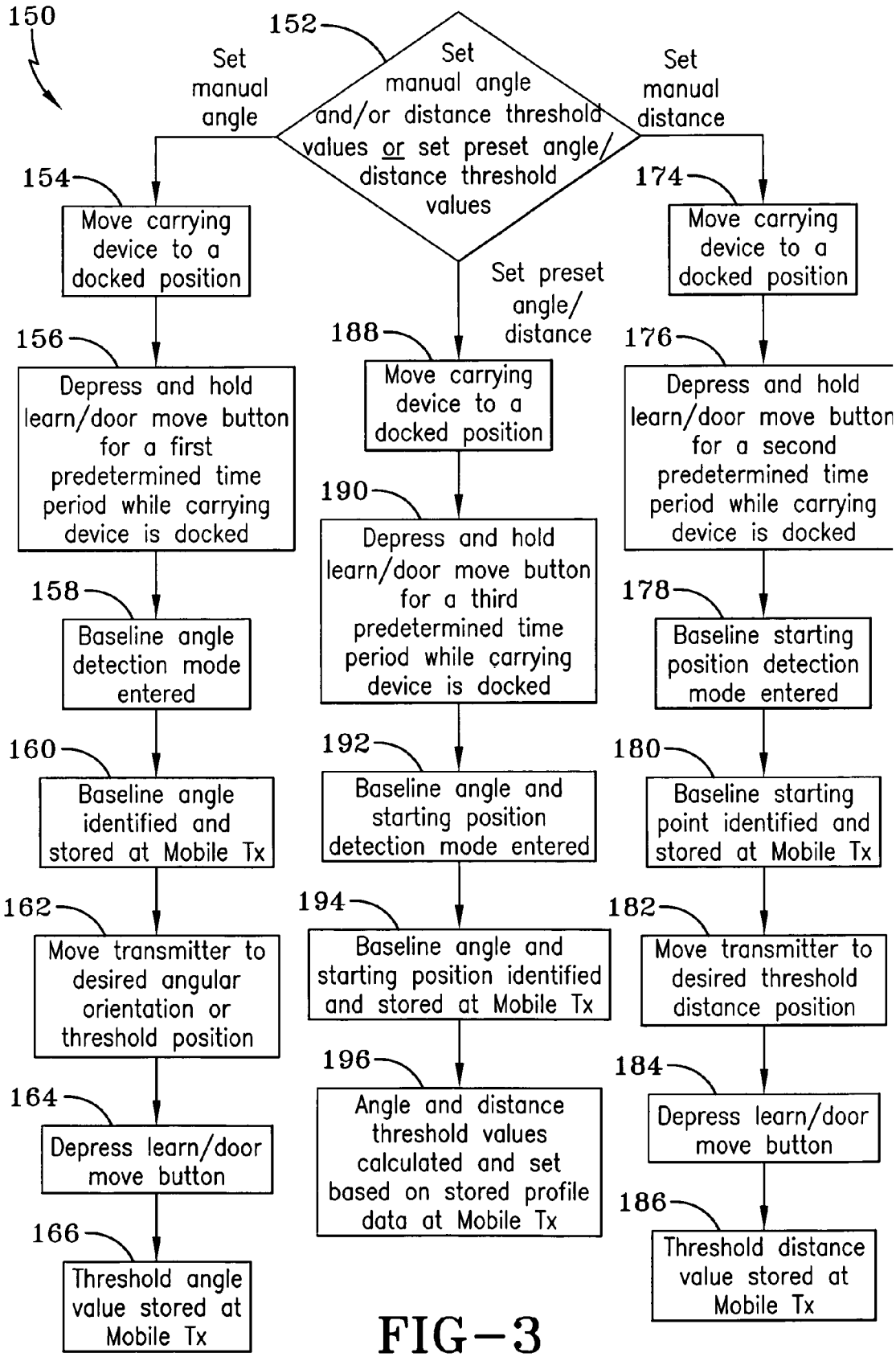
FIG. 3 is a flow diagram showing the operational steps taken by the mobile transmitter to identify and store a threshold angle value and/or a threshold distance value in accordance with the concepts of the present invention.

Furthermore, with the structural and functional aspects of the mobile transmitter 14 set forth, the operational steps taken to establish the threshold positional (angle and distance) values used by the mobile transmitter 14 are indicated generally by the numeral 150 in FIG. 3. Initially at step 152, the user of the mobile transmitter 14 determines whether to manually set the threshold angle value, the threshold distance value, or to use a preset profile to automatically calculate the threshold angle and threshold distance values. The threshold positional (angle and distance) values to initiate a signal can be preset from the factory.

If the user elects to manually set the threshold angle value, the user initially moves the carrying device 20 to a docked, or otherwise stationary position that is within an enclosure whose access is controlled by the access barrier 16, as indicated at step 154. That is, the docked position is where the user of the carrying device 20 would normally park the carrying device 20 when not in use. Next, at step 156 the user depresses and holds the learn/door move button 130 of the mobile transmitter 14 for a first predetermined amount of time while the carrying device 20 is in the docked position to invoke the baseline angle detection mode indicated at step 158. However, it should be appreciated that the baseline angle detection mode may be entered using a variety of techniques, including depressing the learn/door move button 130 and/or on/off button in a predetermined sequence, or any other unique manner of indicating that the mode of step 158 is to be initiated. Next, the baseline angle of the carrying device 20 is generated by the position detector 100, identified and then stored at the mobile transmitter 14, as indicated at step 160. After step 160 is performed, the carrying device 20 and transmitter 14 are moved to a position outside of the enclosure and clear of the path of the access barrier 16, as indicated at step 162. The position outside of the enclosure to which the carrying device 20 is moved should be indicative of the typical driving pattern taken by the user when exiting the enclosure, and preferably is a position that still allows the driver to view the access barrier 16 as he or she is leaving. Once the carrying device 20 is moved to the desired position, the process continues to step 164, where the learn/door move button 130 is depressed, and the current angle value associated with the position of the carrying device 20 established in step 162 is generated by the position detector 100, identified and then stored in the mobile memory unit 80. At step 166, the mobile transmitter 14 calculates and stores the threshold angle value based on the change in magnitude of the angle between the baseline and current angle values identified at steps 160 and 164.

Alternatively, if the user desires to manually set the threshold distance value, the user initially moves the transmitter 14 and the carrying device 20 to a docked, or otherwise stationary position that is within an enclosure whose access is controlled by the access barrier 16, as indicated at step 174. That is, the docked position is where the user of the carrying device 20 would normally park the carrying device 20 when not in use. Next, at step 176 the user depresses and holds the learn/door move button 130 of the mobile transmitter 14 for a second predetermined amount of time, which is different from the amount of time used in step 156, while the carrying device 20 is in the docked position to invoke the baseline distance detection mode indicated at step 178. However, it should be appreciated that the baseline distance detection mode may be entered using a variety of techniques, including depressing the learn/door move button 130 and/or on/off button in a predetermined sequence, or any other unique manner of indicating that the mode of step 178 is to be initiated. Next, the baseline position or starting point at which the carrying device 20 is docked is identified by the activity sensor 110, or in some embodiments the position detector 100 and stored in the memory unit 80, as indicated at step 180. After step 180 is performed, the carrying device 20 is moved to a position outside of the enclosure and clear of the path of the access barrier 16, as indicated at step 182. The position outside of the enclosure to which the carrying device 20 is moved should be indicative of the typical driving pattern taken by the user when exiting the enclosure, and preferably is a position that still allows the driver to view the access barrier 16 as he or she is leaving. Once the carrying device 20 is moved to the desired position, the process continues to step 184, where the learn/door move button 130 is depressed, and the current position of the carrying device established in step 182 is identified by the activity sensor 110 or by the position detector 100 and stored in the mobile memory unit 80. At step 186, the mobile transmitter 14 calculates and stores the threshold distance value based on the distance that is between the baseline starting position and the current position values identified at steps 180 and 184.

The user may also decide to use preset values that have been pre-programmed into the mobile transmitter 14 to set the threshold angle and distance values. To set such values, the user initially moves the carrying device 20 to a docked, or otherwise stationary position that is within an enclosure whose access is controlled by the access barrier 16, as indicated at step 188. That is, the docked position is where the user of the carrying device 20 would normally park the carrying device 20 when not in use. Next, at step 190 the user depresses and holds the learn/door move button 130 of the mobile transmitter 14 for a third predetermined amount of time, which is different from the amount of time used in steps 156 and 176, while the carrying device 20 is in the docked position to invoke the baseline angle and distance detection mode indicated at step 192. However, it should be appreciated that the baseline angle and distance detection mode may be entered using a variety of techniques, including depressing the learn/door move button 130 and/or on/off button in a predetermined sequence, or any other unique manner of indicating that the mode of step 192 is to be initiated. Next, the baseline angle and baseline position/starting point corresponding to the docked position of the carrying device 20 is identified by the position detector 100 and/or the activity sensor 110 and stored at the mobile transmitter 14, as indicated at step 194. Next, at step 196 the angle and distance threshold values are calculated by the mobile controller 74 using the baseline values previously identified in step 194. That, is the mobile transmitter 14 utilizes the pre-programmed criteria, such as a predetermined angular or positional change from the identified baseline values to calculate the threshold angle and threshold distance values, which are then stored in the mobile transmitter 70. For example, the pre-programmed criteria may include angle values of at least 30-45 degrees and/or distance values of at least 15 to 500 feet, although any suitable angle or distance value may be used. For example, the angle change may be as small as five degrees and the distance could be as small as ten feet if the carrying device is a small vehicle such as a motorcycle.

While the operational steps 150 set forth above are indicative of one manner of implementing the identification of the threshold angle and distance values, such should not be construed as limiting, as such process or sequence may be readily modified or altered using known techniques, while still retaining the general functionality of the process 150.

III. Mobile Transmitter/Barrier Operator Operation

Figure 4:
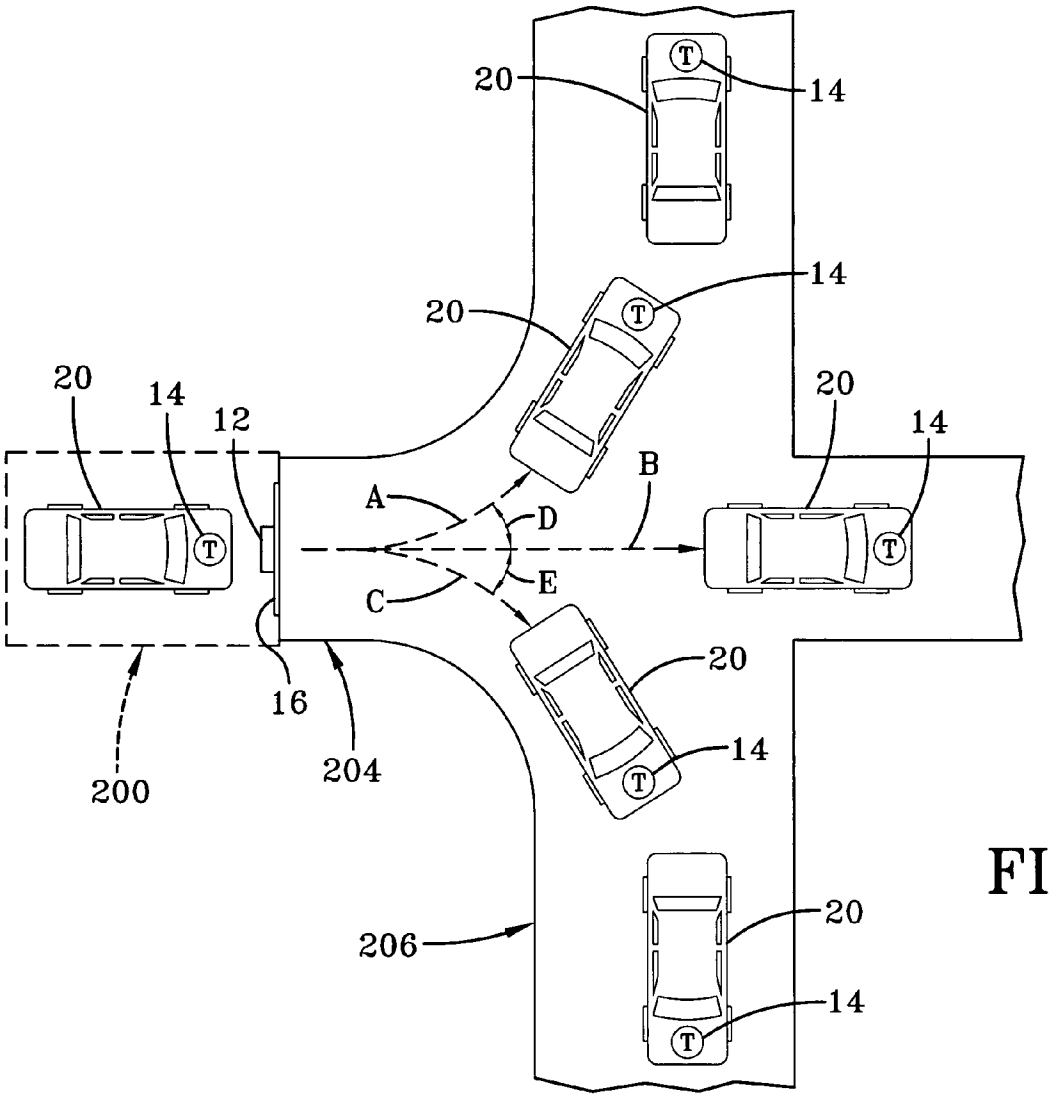
FIG. 4 is a schematic diagram showing various changes in angular and linear distance positions of a carrying device with respect to an access barrier during operation of the system in accordance with the concepts of the present invention.

With the particular structural and functional aspects of the barrier operator 12 and mobile transmitter 14 set forth, the general manner for implementing the auto-close operation of the access barrier 16 will be presented below. As such, in one embodiment, the angle position sensor 100 may comprise a digital compass, while the activity sensor 110 comprises an accelerometer. Such a configuration allows the system 10 to operate without performing vector or floating point mathematical operations, which requires a specialized processor to perform. The predetermined angle threshold value utilized by the mobile transmitter 14 may comprise any value, such as 45 degrees for example, that would indicate that the carrying device 20 is moving away from the access barrier 16. Referring now to FIG. 4, the carrying device 20 is shown carrying the mobile transmitter 14 in various positions with respect to the barrier operator 12. Typically, the carrying device 20 is a vehicle positioned in a garage or other enclosure generally indicated by the numeral 200. The enclosure 200 may be separated from its outer environs by the access barrier 16, which is controlled by the barrier operator 12 in the manner previously described. The enclosure 200 may be accessible by a driveway 204 which may be contiguous with a street 206 or other access-type road.

During operation of the system 10, the carrying device 20 is positionable in the enclosure 200 or anywhere along the length of the driveway 204 and the street 206, whereby the carrying device 20 may be in either a "docked" state inside the enclosure 200 or in relatively close proximity to the enclosure, or in an "away" state anywhere outside the enclosure 200 that does not interfere, or otherwise obstruct the movement of the access barrier 16. As such, as the carrying device 20 exits the enclosure 200 it may proceed generally in one of three general exit paths, identified as A, B, and C. However, it should be appreciated that the paths A, B, and C are not to be construed as limiting, as the carrying device 20 may follow any exit path that allows the carrying device 20 to move from the "docked" state inside or in close proximity to the enclosure 200 to an "away" state sufficiently distanced away from the enclosure 200.

Thus, when the carrying device 20 leaves the "docked" state and exits the enclosure 200, it may proceed along path A to make a left turn, or it may proceed along path C to make a right turn. In either event, the change of the angular orientation of the carrying device 20 between the initial baseline angle identified when the carrying device 20 is initially started in the enclosure 200 and the current angle, identified as D and E, that is obtained as the carrying device 20 is being turned left or right is identified. As such, if during the turn, the change in the angular orientation of the carrying device 20 exceeds the predetermined angle threshold value, indicating it is outside the path of movement of the access barrier 16, the mobile transmitter 14 transmits the command signal to the barrier operator 12 commanding the access barrier 16 to close if the access barrier is in the open position. In addition, the activity sensor 110 may also be used to determine if the carrying device 20 has moved by an amount that exceeds the predetermined distance threshold value, as well. Alternatively, if the carrying device 20 does not make a turn in either direction of A or C, the carrying device 20 may proceed along a path identified as B, which does not result in any changes in angular orientation that exceed that of the predetermined angle threshold value. Thus, because movement of the carrying device 20 along path B does not result in an angular change, the accelerometer comprising the activity sensor 110 is relied upon to determine whether the carrying device 20 has moved from the access barrier 12 a sufficient distance as established by the distance threshold value to send a command signal to close an open access barrier 16. In some embodiments, the position detector 100 may also be able to determine the linear displacement. In any event, when the carrying device 20 moves from an initially "docked" position to an "away" position, the angle position detector 100 and/or the activity sensor 110 monitor the angular change and/or the linear change (distance) of the particular path that is taken by the carrying device 20 and compares the obtained values to threshold values stored in the mobile memory unit 80, so as to automatically send a command signal.

Figure 5:
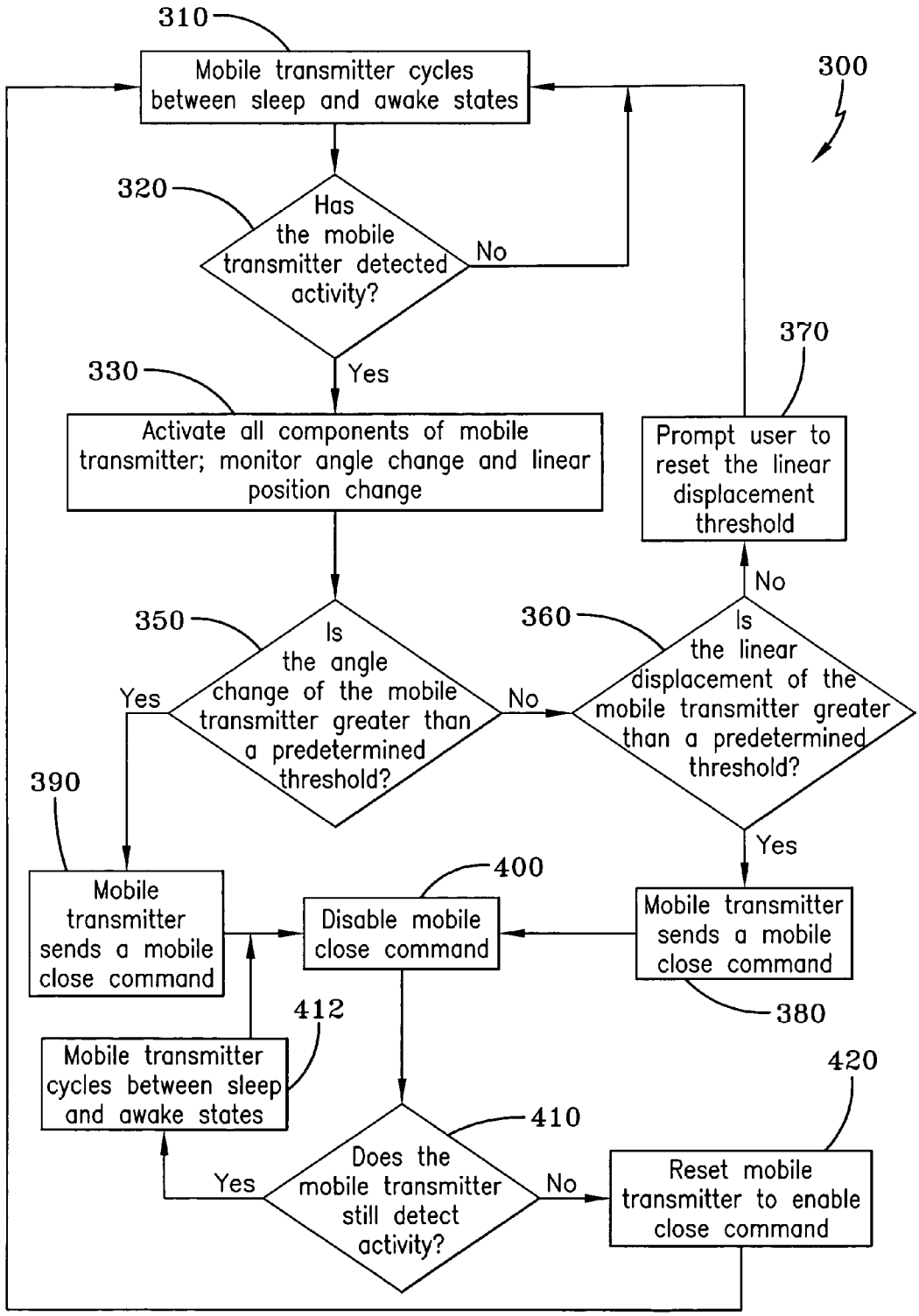
FIG. 5 is a flow diagram showing the operational steps taken by the system as the carrying device changes position in accordance with the concepts of the present invention.

While the previous discussion has set forth the general operating steps taken by the mobile transmitter 14, it should be appreciated that the specific operational steps, generally referred to by the numeral 300, for carrying out the auto-close features contemplated herein will now be set forth below as shown in FIG. 5. Specifically, the operational steps set forth in FIG. 5 describe the operation of the mobile transmitter 14 as it carries out the auto-close function. Initially, at step 310, the mobile transmitter 14 cycles continuously between sleep and awake states to conserve power usage. For example, the sleep and awake states may comprise respective time periods of 2 seconds and 1 millisecond, although any other suitable time periods may be used. That is, during a sleep state, the mobile transmitter 14 may be powered off, or placed in a low-power mode. It is also contemplated that the sleep state and/or awake state may be configured such that only some of the components of the mobile transmitter 14 may be turned off or on. For example, the mobile transmitter 14 may be configured so that only the position detector 100 is active during the awake state, while the remaining components of the mobile transmitter 14 are off. During an awake state of the mobile transmitter 14, the process determines whether the mobile transmitter 14 has detected any activity or movement of the carrying device 20 via the activity sensor 110, as indicated at step 320. If the mobile transmitter 14 has not detected any activity of the carrying device 20, the process returns to step 310, where the mobile transmitter 14 resumes cycling between sleep and awake states as previously discussed. However, if the mobile transmitter 14 has detected that the carrying device 20 is active, the process continues to step 330. At step 330, all of the components of the mobile transmitter 14 are fully activated, and the position detector 100 begins to monitor the angular change in position of the carrying device 20, as well as any changes in linear displacement or position of the carrying device 20. Next, the process continues to step 350, where the mobile transmitter 14 determines whether the change in angular position of the carrying device 20 is greater than a predetermined threshold value. For example, the threshold angle value may be at least 35 to 45 degrees, although any other suitable angle may be used. If the change in angular position of the carrying device 20 does not exceed the predetermined threshold angle value, then the process continues to step 360. At step 360, the process determines whether the linear displacement of the carrying device 20, as determined by the mobile transmitter 14, is greater than a predetermined threshold distance value. For example, the threshold distance value may be between about 15 to 500 feet, although any other linear distance value may be utilized. If the amount of linear displacement of the carrying device 20 is not greater than the predetermined threshold value, the process continues to step 370, where the user is prompted, via the audio source 140 or the light source 150 to reset the linear displacement threshold value via the process 150, before returning to step 310. Returning to step 360, if the linear displacement of the carrying device 20, as determined by the mobile transmitter 14, does exceed the predetermined threshold value, then the process continues to step 380, where the mobile transmitter 14 transmits a command signal 21 to the barrier operator 12 to automatically close an open access barrier 16.

Returning to step 350, if the change in angular position of the carrying device 20, as determined by the mobile transmitter 14 is greater than the predetermined angular threshold value, then the process continues to step 390. At step 390, the mobile transmitter 14 transmits a command signal 21 to the barrier operator 12 to automatically close an open access barrier 16.

Thus, at steps 380 and 390 of the process the mobile transmitter 14 transmits a command signal 21 to the barrier operator 12 to automatically close an open access barrier 16. Once the command signal 21 is transmitted to the barrier operator 12, the process continues to step 400, where the ability of the mobile transmitter 14 to automatically transmit a command signal of any type is disabled. By preventing generation of unneeded command signals, power drain at the transmitter's battery is reduced and unexpected operation of the barrier is prevented. And such a feature reduces the possibility of interference with other devices. Of course, the user could actuate the remote transmitter in a normal manner to move the position of the door. After the ability of the mobile transmitter 14 to transmit a mobile close signal 21 is disabled, the process continues to step 410. At step 410 the process determines whether the mobile transmitter 14 is still detecting any activity of the carrying device 20. If the mobile transmitter 14 is detecting activity of the carrying device 20, the process continues to step 412, whereby the mobile transmitter 14 resumes cycling between sleep and awake states to prolong battery life. However, if at step 410, the mobile transmitter 14 does not detect any activity at the carrying device 20, then the process continues to step 420. At step 420 the mobile transmitter 24 is reset so as to allow it to be capable of transmitting a subsequent command signal 21, whereupon the process returns to step 310.

Figure 6:
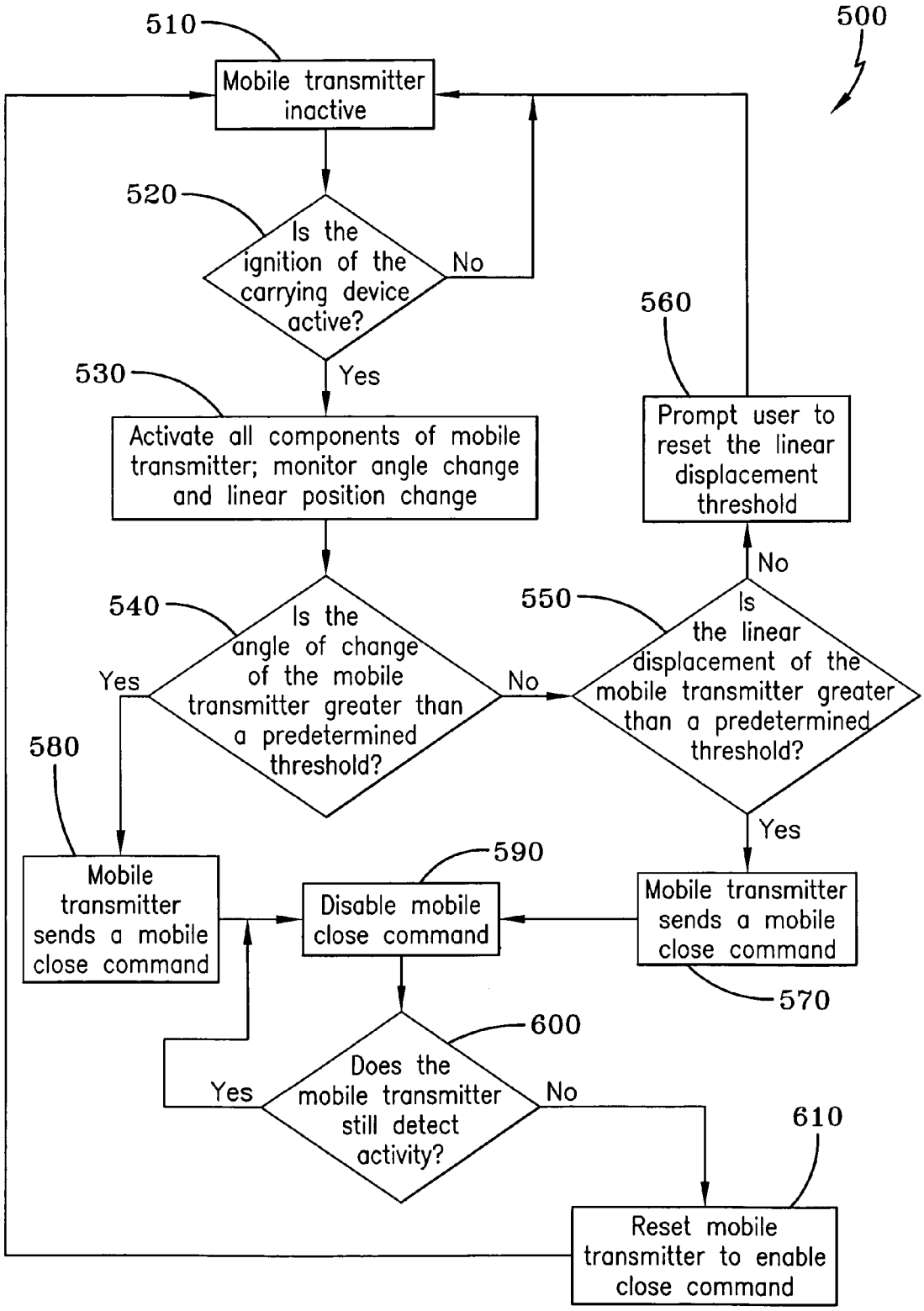
FIG. 6 is a flow diagram showing the operational steps for an alternative embodiment of the system in accordance with the concepts of the present invention.

In another embodiment of the present invention, it is contemplated that the angle position detector 100 comprises a two-axis analog compass, although a two-axis digital compass may also utilized. Furthermore, in this embodiment the activity sensor 110 comprises an ignition sensor or detector that is used to determine when the carrying device 20 is active. As such, the operational steps taken by the system 10 when utilizing the two-axis compass and ignition sensor are generally referred to by the numeral 500 in FIG. 6. Initially, at step 510, the carrying device 20, such as a vehicle, is in a "docked" state, or otherwise parked within the enclosure 200, such that the mobile transmitter 14 is in an inactive state as the ignition of the carrying device 20 is in an "off" state. That is, the mobile transmitter 14 is configured so that it is powered off when the ignition of the carrying device 20 is deactivated. Continuing to step 520, the process determines if the ignition of the carrying device 20 has been activated. If the ignition of the carrying device 20 has not been activated, then the process returns to step 510, where the mobile transmitter 14 remains in an inactive state. However, if the ignition of the carrying device 20 has been activated, as detected by the activity sensor 110, then the process continues to step 530. At step 530, all of the components of the mobile transmitter 14 are made active, or are otherwise turned "on," and the two-axis compass comprising the angle position detector 100 begins to monitor for any change in angular position as well as any change in linear position of the carrying device 20. Somewhat simultaneously with step 530, the step 540 is performed, whereby the process determines whether the carrying device 20 has sustained an angular change that is greater than a predetermined threshold value. If the carrying device 20 has not sustained a change in angular position that is greater than the predetermined threshold angle value, then the process continues to step 550. At step 550, the process determines whether the change in linear displacement of the carrying device 20 is greater than a predetermined threshold distance value. If the amount of linear displacement of the carrying device 20 is not greater than the predetermined threshold distance value, the process continues to step 560, where the user is prompted, via the audio source 140 or the light source 146 to reset the predetermined threshold distance value via the process 150, before returning to step 510.

Returning to step 550, if the linear displacement of the carrying device 20, as determined by the mobile transmitter 14, does exceed the predetermined threshold distance value, the process continues to step 570, where the mobile transmitter 14 transmits a command signal 21 to the barrier operator 12 to automatically close an open access barrier 16.

Returning to step 540, if the change in angular position of the carrying device 20, as determined by the mobile transmitter 14 is greater than the predetermined threshold angle value, then the process continues to step 580. At step 580, the mobile transmitter 14 transmits a command signal 21 to the barrier operator 12 to automatically close an open access barrier 16.

Thus, at steps 570 and 580 of the process the mobile transmitter 14 transmits a command signal 21 to the barrier operator 12 to automatically close an open access barrier 16. Once the command signal 21 is transmitted to the barrier operator 12, the process continues from either of steps 570 and 580 to step 590, where the ability of the mobile transmitter 14 to automatically transmit a command signal of any type is disabled. As noted previously, such a feature reduces the possibility of interference with the operation of other devices and unexpected operation of the barrier is prevented. Of course, the user could actuate the remote transmitter in a normal manner to move the position of the door. After the ability of the mobile transmitter 14 to transmit a command signal 21 is disabled, the process continues to step 600. At step 600, the process determines whether the mobile transmitter 14 still detects that that the ignition of the carrying device 20 is active. Thus, if the mobile transmitter 14 detects that the ignition of the carrying device 20 is still active, the process returns to step 590. However, if the mobile transmitter 14 does not detect that the ignition of the carrying device 20 is still active, the process continues to step 610. At step 610, the ability of the mobile transmitter 14 to transmit a command signal 21 is reset, or otherwise re-enabled, whereupon the process returns to step 510. It will be appreciated that step 550 may be considered a secondary test in the event a specified change in angle is not detected at step 540. Skilled artisans will also appreciate that linear displacement could be the primary test and angular displacement the secondary test for whether to generate a command signal. And in some embodiments, a secondary test may not be provided.

Based upon the foregoing, one advantage of the hands-free operator system is that it provides a mobile transmitter that maintains an angle position detector that is capable of determining when the angular position of a carrying device exceeds a predetermined value, so as to automatically close an open access barrier. Another advantage of the operator system is that the mobile transmitter provides an activity sensor that is capable of determining when the linear movement of a carrying device exceeds a predetermined value, so as to automatically close an open access barrier. Still another advantage of the hands-free operator system is that the mobile transmitter is able to determine the whether the carrying device is not in the path of travel of the access barrier without the use of floating point or vector based calculations.

Thus, it can be seen that the objects of the invention have been satisfied by the structure and its method for use presented above. While in accordance with Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

The invention claimed is:

1. A method of automatically closing an open access barrier based on a change in position of a carrying device in proximity to the access barrier comprising:

providing a standalone mobile transmitter in a carrying device, said standalone mobile transmitter configured to internally detect movement and an angular change in position of the carrying device with an angular position detector;

providing any barrier operator adapted for use with said standalone mobile transmitter to control the movement of the access barrier between limit positions without any other external data input;

moving the carrying device from a first position to a second position;

determining whether the movement and the angular change of the carrying device exceeds a predetermined threshold angle value and distance;

automatically transmitting a signal from said mobile transmitter to said barrier operator; and automatically closing the open access barrier without any other external data input if the angular change in position of the carrying device detected by said angular position detector exceeds said predetermined threshold angle value and distance.

2. The method of claim 1 further comprising:

providing said angular position detector with an accelerometer;

internally detecting by said mobile standalone transmitter, whether a linear movement of said carrying device as determined by said accelerometer exceeds a predetermined threshold distance value; and transmitting said signal to said barrier operator to automatically close the open access barrier if said predetermined threshold distance value is exceeded and said predetermined threshold angle value has not been exceeded.

3. The method of claim 2, further comprising;

continuously cycling between a sleep state and an awake state, such that if said mobile transmitter detects that the carrying device is active during said awake state, said mobile transmitter is fully turned on.

4. The method of claim 2, further comprising;

detecting whether the carrying device is on and awaiting said mobile transmitter to perform the determining and transmitting functions.

5. The method of claim 2, further comprising setting said predetermined threshold distance value at least at 15 to 500feet.

6. The method of claim 1, further comprising setting said predetermined threshold angle value at least at 35 to 45 degrees.

7. The method of claim 2, further comprising:

disabling transmission of said signal for a predetermined period of time after automatically transmitting said signal even if said carrying device continues to move.

8. The method of claim 7, further comprising:

determining whether said standalone mobile transmitter continues to detect activity of the carrying device; and resetting said standalone mobile transmitter to enable transmission of said signal if no activity is detected or maintaining disablement of said signal if activity is detected.

* * * * *